US008606150B2

(12) United States Patent
Yamashita et al.

(10) Patent No.: US 8,606,150 B2
(45) Date of Patent: Dec. 10, 2013

(54) TONER BEARER, AND DEVELOPING DEVICE AND IMAGE FORMING APPARATUS USING SAME

(75) Inventors: Yasuyuki Yamashita, Kanagawa (JP); Ryohichi Kitajima, Kanagawa (JP); Shohei Gohda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 296 days.

(21) Appl. No.: 13/216,496

(22) Filed: Aug. 24, 2011

(65) Prior Publication Data

US 2012/0063816 A1 Mar. 15, 2012

(30) Foreign Application Priority Data

Sep. 14, 2010 (JP) ..... 2010-205179
Sep. 14, 2010 (JP) ..... 2010-205282

(51) Int. Cl.
*G03G 15/10* (2006.01)

(52) U.S. Cl.
USPC ..... 399/239; 399/119; 399/159; 399/350; 399/279

(58) Field of Classification Search
USPC ..... 399/119, 176, 239, 159, 350, 313, 279
See application file for complete search history.

(56) References Cited

U.S. PATENT DOCUMENTS 5,839,029 A * 11/1998 Kataoka et al. ..... 399/115
7,267,916 B2 9/2007 Sugino et al.
7,537,872 B2 5/2009 Toda et al.
7,560,204 B2 7/2009 Toda et al.
7,728,060 B2 * 6/2010 Minagoshi et al. ..... 524/167
7,960,081 B2 6/2011 Orito et al.
2007/0059618 A1 3/2007 Kurimoto et al.
2008/0226350 A1 * 9/2008 Goto et al. ..... 399/240

FOREIGN PATENT DOCUMENTS

JP 3-21967 1/1991
JP 2007-133388 5/2007
JP 2009-3314 1/2009
JP 2009-157096 7/2009
JP 2010-39354 2/2010

* cited by examiner

*Primary Examiner* — Walter L Lindsay, Jr.
*Assistant Examiner* — Roy Y Yi
(74) *Attorney, Agent, or Firm* — Cooper & Dunham LLP

(57) ABSTRACT

A toner bearer including an electroconductive substrate; an insulating layer located on the electroconductive substrate; multiple electrodes located on the insulating layer at regular intervals; an outermost layer located on the multiple electrodes; and a voltage applicator to apply a voltage between the electroconductive substrate and the multiple electrodes to form a periodically reversed electric field therebetween so that toner particles on the outermost layer hop, thereby forming a toner cloud above the outermost layer. The insulating layer includes a crosslinked material having a unit obtained from a fluorine-containing resin and a crosslinking agent. The fluorine-containing resin is selected from the group consisting of copolymers having a unit obtained from fluoroethylene having at least three fluorine atoms and a unit obtained from a vinyl ether monomer and copolymers including a unit obtained from tetrafluoroethylene and a unit obtained from a vinyl monomer.

8 Claims, 3 Drawing Sheets

TONER BEARER, AND DEVELOPING DEVICE AND IMAGE FORMING APPARATUS USING SAME

CROSS-REFERENCE TO RELATED APPLICATIONS

This patent application is based on and claims priority pursuant to 35 U.S.C. §119 to Japanese Patent Applications Nos. 2010-205282 and 2010-205179, each filed on Sep. 14, 2010, in the Japan Patent Office, the entire disclosure of which is hereby incorporated herein by reference.

FIELD OF THE INVENTION

This disclosure relates to a toner bearer to bear a toner thereon. In addition, this disclosure relates to a developing device and an image forming apparatus, which form a toner image using the toner bearer.

BACKGROUND OF THE INVENTION

Electrophotographic image forming apparatuses such as copiers and printers form visible images using one or more developing devices. Among various developing devices, non-contact developing devices which develop an electrostatic image formed on an image bearer such as a photoreceptor with a toner born on a toner bearer without contacting the toner bearer with the photoreceptor attract attention. Specific examples of these non-contact developing devices include powder cloud developing devices, jumping developing devices, and field curtain developing devices.

In jumping developing devices, a voltage is applied to a toner bearer to allow toner particles, which are adhered to the toner bearer at an adhesive force, to jump to the surface of an image bearer such as a photoreceptor.

In field curtain developing devices, an alternate electric field is applied to multiple electrodes arranged on a surface of a toner bearer at regular intervals to form an alternate unequal electric field, thereby forming a field curtain, so that previously charged toner particles on the surface of the toner bearer are supplied to an electrostatic latent image on a surface of an image bearer by hopping. In this regard, since toner particles hop from the surface of the toner bearer, and the adhesive force of the toner particles becomes substantially zero, it is not necessary to apply a force to the toner particles to release the toner particles from the surface of the toner bearer. Accordingly, in field curtain developing devices, toner particles can be fed to an image bearer at a relatively low applied voltage.

A field curtain developing device is proposed which uses a toner bearer in which an insulating protective layer is formed on the surface of multiple electrodes to prevent leaking of charges of toner particles to the electrodes, thereby preventing occurrence of defective hopping of the toner particles due to loss of charges of the toner particles.

Another field curtain developing device is proposed which has a toner bearer whose surface is made of a material capable of frictionally charging toner particles so as to have charges with a predetermined polarity so that toner particles supplied to the toner bearer hop and are desirably charged by applying an alternate voltage thereto.

In these field curtain developing devices, two kinds of electrodes having different electric potentials are arranged on an insulating layer. When the gap between the two kinds of electrodes is relatively narrow, electric leakage tends to occur therebetween. In this case, the electrodes cannot maintain the electric potentials, and therefore toner particles thereon cannot hop.

In attempting to prevent the leaking problem, a technique is proposed in which an insulating layer is formed on an electroconductive substrate serving as an electrode, and another electrode is formed on the insulating layer so that the two kinds electrodes are separated by the insulating layer.

In this case, when an alternate electric field or a rectangular pulse is applied to the electrodes to form an electric field allowing toner particles to hop, an electrostatic force is formed between the electroconductive substrate and the electrode formed on the insulating layer, thereby storing a large amount of charge. Therefore, a large amount of electric power is consumed, and it is necessary to reduce electric power consumption.

For these reasons, the inventors recognized that there is a need for a field curtain developing device in which a toner cloud is stably formed at a low electric power consumption so that toner particles are stably supplied to an electrostatic latent image on an image bearer.

BRIEF SUMMARY OF THE INVENTION

As an aspect of this disclosure, a toner bearer is provided which includes an electroconductive substrate; an insulating layer located on the electroconductive substrate; multiple electrodes located on the insulating layer at regular intervals; an outermost layer located on the multiple electrodes and a portion of the insulating layer on which the multiple electrodes are not present; and a voltage applicator to apply a voltage between the electroconductive substrate and the multiple electrodes to form a periodically reversed electric field therebetween, so that toner particles on the outermost layer hop, thereby forming a toner cloud above the outermost layer. The insulating layer includes at least a crosslinked material having a unit obtained from a fluorine-containing resin and a crosslinking agent. The fluorine-containing resin is selected from the group consisting of copolymers having a unit obtained from fluoroethylene having at least three fluorine atoms and a unit obtained from a vinyl ether monomer and copolymers including a unit obtained from tetrafluoroethylene and a unit obtained from a vinyl monomer.

As another aspect of this disclosure, a developing device is provided which includes a developer container containing a toner therein; an agitator to agitate the toner in the developer container; the above-mentioned toner bearer; and a toner layer forming member to form a toner layer on the toner bearer. Toner particles in the toner layer formed on the toner bearer hop and thereby a toner cloud is formed above the outermost layer of the toner bearer so that an electrostatic latent image on an image bearing member is developed with the toner cloud.

As yet another aspect of this disclosure, an image forming apparatus is provided which includes an image bearing member to bear an electrostatic latent image thereon; and the above-mentioned developing device to develop the electrostatic latent image with the toner cloud to form a toner image on the image bearing member.

The aforementioned and other aspects, features and advantages will become apparent upon consideration of the following description of the preferred embodiments taken in conjunction with the accompanying drawings.

DETAILED DESCRIPTION OF THE INVENTION

The image forming apparatus of this disclosure will be described by reference to drawings.

Figure 1:
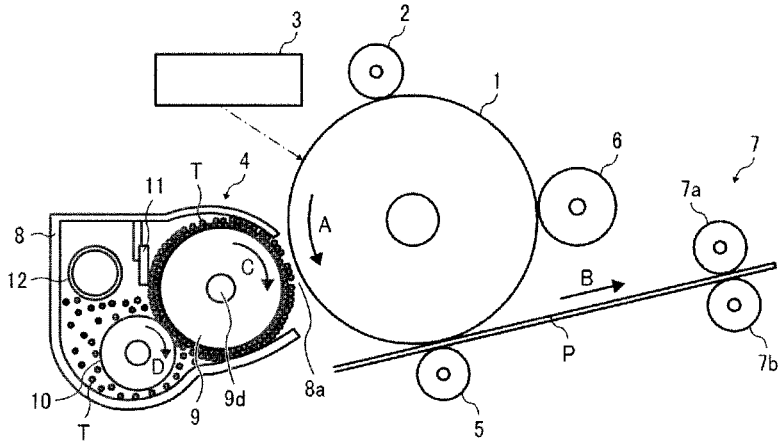
FIG. 1 is a schematic view illustrating an example of the image forming apparatus of this disclosure.

FIG. 1 is a schematic sectional view illustrating an example of the image forming apparatus of this disclosure.

Referring to FIG. 1, the image forming apparatus includes a drum-shaped photoreceptor 1 which serves as an electrostatic latent image bearer and which rotates in a direction (A); a charging roller 2 serving as a charger to evenly charge a surface of the photoreceptor 1; an irradiating device 3 to irradiate the charged photoreceptor 1 with light (such as laser light) according to image information to form an electrostatic latent image on the photoreceptor 1; a developing device 4 to supply a toner to the surface of the photoreceptor 1 bearing the electrostatic latent image to form a toner image on the photoreceptor 1: a transfer roller 5 serving as a transferring device to transfer the toner image onto a recording material (P) (such as a paper sheet); a cleaner 6 to remove residual toner particles from the surface of the photoreceptor 1 after transferring the toner image; and a fixing device 7 to fix the toner image on the recording material (P) upon application of heat and pressure thereto.

Next, the method for forming a toner image on the receiving material P in the image forming apparatus will be described.

The charging roller 2 applies a predetermined voltage to the surface of the photoreceptor 1 rotating in the direction (A) to evenly charge the surface of the photoreceptor 1. The irradiating device 3 irradiates the thus charged photoreceptor 1 with laser light according to information of an image to be output to form an electrostatic latent image on the photoreceptor 1. The developing device 4 supplies a toner to adhere the toner to the electrostatic latent image, resulting in formation of a toner image on the surface of the photoreceptor 1. The transfer roller 5 contacts the recording material (P) with the surface of the photoreceptor 1 while feeding the recording material in a direction (B) and applying a bias voltage thereto to transfer the toner image onto the recording material (P). The fixing device 7 heats and presses the recording material (P) bearing the toner image thereon using a heat roller 7*a* and a pressure roller 7*b* to fix the toner image on the receiving material (P). After the toner image on the photoreceptor 1 is transferred, the cleaner 6 removes residual toner particles from the surface of the photoreceptor 1 so that the surface of the photoreceptor is ready for the next charging operation. The image forming apparatus repeats the charging, irradiating, developing, transferring, cleaning, and fixing processes to sequentially produce visual images.

Next, the developing device of this disclosure will be described.

As illustrated in FIG. 1, the developing device 4 includes a container 8 containing a toner (one-component developer) (T); and a toner bearer 9 which is rotated in a direction (C) by a driving device (not shown) to supply the toner (T) to the photoreceptor 1 through an opening 8*a* of the container 8. In addition, the developing device 4 includes a circulating paddle 10 to agitate and circulate the toner (T) to charge the toner while feeding the toner toward the surface of the toner bearer 9.

The toner thus fed to the toner bearer 9 is drawn thereby while born thereon by an electrostatic force. The thus drawn toner T is then scraped with a blade 11 serving as a toner layer forming member (i.e., a developer layer thickness controlling member) to form a toner layer having a predetermined thickness on the toner bearer 9. As mentioned below, an alternate electric field is formed on a portion of the toner bearer 9 located at the opening 8*a* to form a toner cloud. Toner particles in the toner cloud are electrostatically supplied to an electrostatic latent image on the surface of the photoreceptor 1, thereby forming a toner image on the surface of the photoreceptor 1. In FIG. 1, numeral 12 denotes a toner supplying opening through which a supplementary toner is supplied to the container 8.

Next, the toner bearer 9 will be described in detail.

Figure 2:
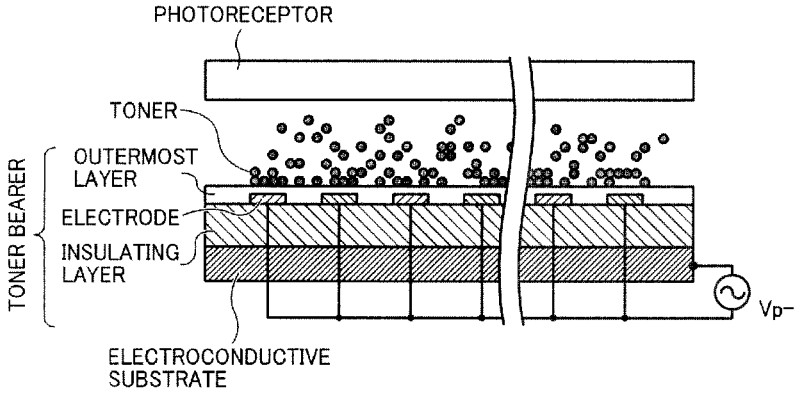
FIG. 2 is a schematic view illustrating a toner cloud formed on a surface of an example of the toner bearer of this disclosure.

As illustrated in FIG. 2, the toner bearer includes an electroconductive substrate positioned at the bottom of the toner bearer, an insulating layer located on the electroconductive substrate, multiple electrodes located on the insulating layer, and an outermost layer located on the electrodes and a portion of the insulating layer on which the multiple electrodes are not present.

Figure 3B:
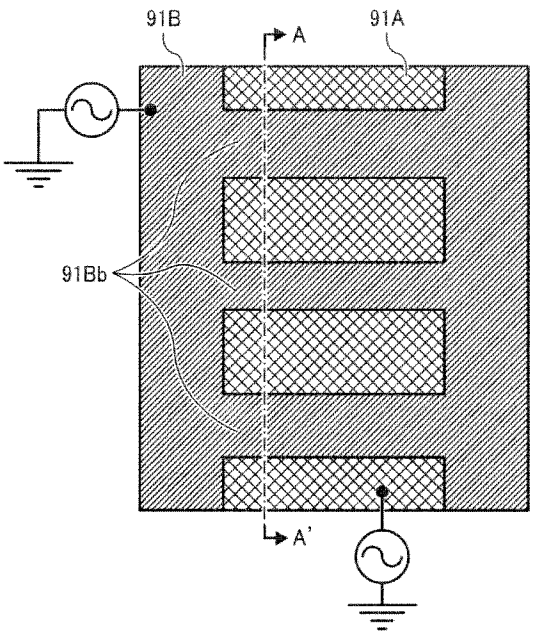
FIGS. 3A and 3B illustrate an example of the toner bearer of this disclosure.
Figure 3A:
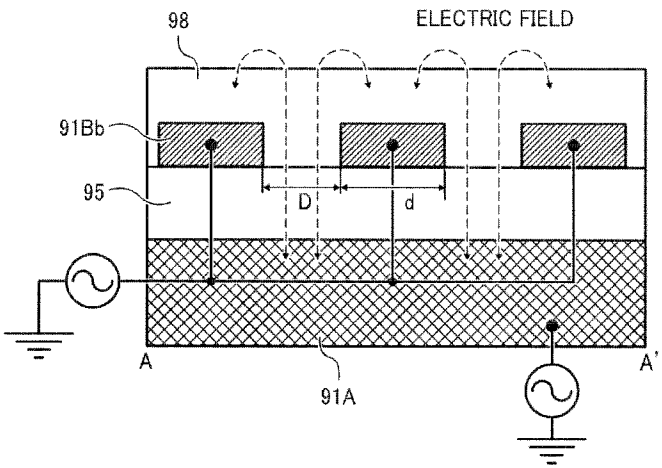

FIGS. 3A and 3B illustrate an example of the toner bearer of this disclosure. FIG. 3A illustrates the cross-section of the toner bearer along a line A-A' illustrated in FIG. 3B. As illustrated in FIG. 3A, the toner bearer includes a first electrode and a second electrode. In this regard, an electroconductive substrate 91A serves as the first electrode (lower electrode), and a patterned electrode 91B, which has multiple linear electrodes 91Bb, serves as the second electrode (upper electrode). A potential difference is formed between the electroconductive substrate 91A (hereinafter sometimes referred to as a phase A) and the patterned electrode 91B (hereinafter sometimes referred to as a phase B), so that toner particles on the surface of the toner bearer hop, resulting in formation of a toner cloud above the surface of the toner bearer.

The patterned electrode 91B can be formed, for example, by forming a thin copper layer on the peripheral surface of a cylindrical substrate (91A), and then making the patterned electrode using a photo-resist method. The method for making the patterned electrode is not limited to the photo-resist method, and an inkjet method in which the patterned electrode is drawn by an inkjet device can also be used.

Specific examples of the material constituting the electroconductive substrate include materials having a high electroconductivity, such as aluminum and aluminum alloys. The size of the electroconductive substrate 91A is not particularly limited. In addition, the width (d) of each of the electrodes 91Bb, and the interval (D) between one of the electrodes 91Bb and the adjacent electrode 91Bb are not particularly limited, and are properly determined. In this regard, since the interval (D) between two adjacent electrodes 91Bb can be increased so as to be relatively long compared to a comb-form electrode mentioned below, chance of short circuit can be reduced.

The state of the thus formed toner cloud changes depending on variables such as width (d) of the patterned electrodes 91Bb, the interval (D) between the electrodes 91Bb, the applied alternate voltage, etc. In order to form a well-conditioned toner cloud on the surface of the toner bearer 9, the width (d) of each of the electrodes 91Bb, and the interval (D) between two adjacent electrodes 91Bb are preferably from 40 μm to 250 μm, and from 85 μm to 500 μm, respectively. In addition, the applied alternate voltage preferably has a frequency of from 100 Hz to 5 KHz, and a voltage of from 100V to 3 KV.

Any materials having a high electroconductivity are preferably used for the electrodes 91Bb. When forming the electrodes 91Bb, a paste-form material is preferably used because a patterned electrode can be easily formed.

In this example, the alternate voltage applied to the toner bearer 9 is a single-phase alternate voltage. However, multi-phase alternate voltages having plural phases with different cycles or phases (of cause, the vectorial sum is not zero) can also be used. By applying an alternate voltage (i.e., a voltage periodically changing its polarity (positive and negative)) to the first and second electrodes, the direction of the electric field at the surface of the toner bearer periodically changes, and thereby toner particles hop in the gap between the surface of the photoreceptor 1 and the surface of the toner bearer 9, thereby forming a toner cloud in the gap. The hopping toner particles are attracted to an electrostatic latent image on the surface of the photoreceptor 1, resulting in formation of a toner image on the surface of the photoreceptor 1.

Specific examples of the electroconductive substrate 91*a* include cylindrical substrates made of metals such as Al, Ni, Fe, Cu and Au or metal alloys of two or more of these metals; cylindrical substrates in which a thin film of an electroconductive material such as metals (e.g., Al, Ag and Au) and metal oxides (e.g., $In_2O_3$ and $SnO_2$) is formed on a cylindrical insulating substrate made of an insulating material such as polyesters, polycarbonates, polyimides and glass; cylindrical resin substrates in which a powder of an electroconductive material such as carbon blacks, graphite, aluminum, copper, nickel and electroconductive glass is dispersed; cylindrical electroconductive paper substrates; etc.

Next, the insulating layer 95 sandwiched by the electroconductive substrate 91A and the multiple electrodes 91Bb will be described.

When an alternate voltage is applied between the electroconductive substrate 91A and the electrodes 91Bb, the electric power consumption is proportional to the dielectric constant of the insulating layer 95. Therefore, the dielectric constant of the insulating layer 95 is as small as possible. In addition, the insulating layer 95 is needed to have such a high insulating property as to prevent the alternate voltage applied to the electrodes 91Bb from leaking into the electroconductive substrate 91A. Further, the electrodes 91Bb and the outermost layer 98 can be satisfactorily formed on the insulating layer 95. For example, when the electrodes 91Bb and the outermost layer 98 are formed on the insulating layer 95 by a coating method using an organic solvent, it is preferable that the insulating layer 95 is not damaged by the organic solvent included in the coating liquid, i.e., the insulating layer preferably has good resistance to the organic solvent.

As a result of the present inventors' investigation, an insulating layer fulfilling these requirements while reducing the electric power consumption of the toner bearer can be provided by using a material including a crosslinked material including a unit obtained from a fluorine-containing resin and a crosslinking agent. The fluorine-containing resin is preferably a copolymer having a unit obtained from fluoroethylene having at least three fluorine atoms and a unit obtained from a vinyl ether monomer, or a copolymer including a unit obtained from tetrafluoroethylene and a unit obtained from a vinyl monomer.

It is more preferable that the fluorine-containing resin is a polyol, and the crosslinking agent is a polyisocyanate capable of crosslinking the polyol, to form a thin film of the insulating layer, which has little thickness variation.

It is well known that PTFE and polyethylene have a low dielectric constant. However, these resins are insoluble or hardly soluble in organic solvents, and therefore it is difficult to form a thin layer thereof, which has a smooth surface on the order of micrometers, on a surface of a substrate. Therefore, there is a need for a wet method by which a thin film having such a smooth surface can be prepared. However, materials soluble in organic solvents typically include organic solvent-soluble functional groups therein, and therefore have a relatively high dielectric constant, resulting in increase of the electric power consumption of the toner bearer. Thus, a trade-off relationship is established.

By using a copolymer having a unit obtained from fluoroethylene having at least three fluorine atoms and a unit obtained from a vinyl ether monomer or a copolymer including a unit obtained from tetrafluoroethylene and a unit obtained from a vinyl monomer for the fluorine-containing resin, each of which copolymers is soluble in organic solvents, a thin film having a smooth surface with roughness on the order of micrometers can be prepared by a wet method. In addition, since these copolymers have a relatively low dielectric constant, the resultant insulating layer can have a low dielectric constant.

Hereinafter, these copolymers will be described in detail.

Copolymers having a unit obtained from fluoroethylene having at least three fluorine atoms and a unit obtained from a vinyl ether monomer or copolymers including a unit obtained from tetrafluoroethylene and a unit obtained from a vinyl monomer are soluble in organic solvents because the unit obtained from a vinyl ether monomer or a vinyl monomer is soluble in organic solvents. Therefore, by using a conventional coating method, a thin film having a smooth surface can be easily formed on an electroconductive substrate.

In addition, such copolymers have good insulating property. Further, the resultant insulating layer (i.e., crosslinked resin) has good resistance to organic solvents, and therefore the insulating layer is not damaged when the electrodes and the outermost layer are formed thereon using an organic solvent.

Specific examples of the copolymers having a unit obtained from fluoroethylene having at least three fluorine atoms and a unit obtained from a vinyl ether monomer include LUMIFLON LF-100, LF-200, LF-200F, LF-302, LF-400, LF-600, LF-600X, LF-800, LF-906N, LF-910N, LF-916N, LF-936, and LF-9010, which are from Asahi Glass Co., Ltd. and each of which has the following formula (1):

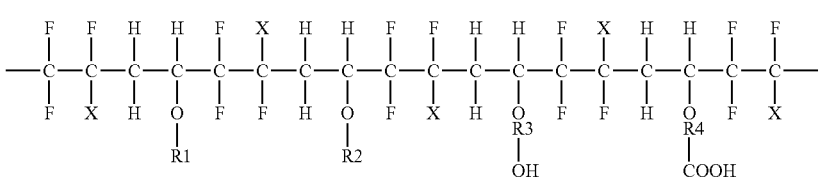

wherein X represents a fluorine atom or a chlorine atom; each of R1 and R2 represents an alkyl group; and each of R3 and R4 represents an alkylene group.

These copolymers can be used alone or in combination.

Specific examples of the copolymers having a unit obtained from tetrafluoroethylene and a unit obtained from a vinyl monomer include ZEFFLE GK-500, GK-510, GK-550, GK-570, and GK-580, which are from Daikin Industries, Ltd. These copolymers can be used alone or in combination.

Suitable materials for use as the crosslinking agent include polyisocyanates. By using a polyisocyanate, a fluorine-containing resin (polyol) can be crosslinked while hardly increasing the dielectric constant of the crosslinked resin compared to the dielectric constant of the copolymer.

Specific examples of such polyisocyanates include DURANATE THA-100, TPA-100, TSS-100, TSE-100, and TSR-100, which are from Asahi Kasei Chemicals Corp.; SUMIDUR N3300 from Sumika Bayer Urethane Co., Ltd.; TAKENATE D-177N, D-173N and D-140N, which are from Mitsui Chemicals Inc.; and CORONATE HX from Nippon Polyurethane Industry Co., Ltd. These materials can be used alone or in combination.

In order to enhance the preservability of an insulating layer coating liquid at room temperature, polyisocyanates having a blocked isocyanate structure are preferably used.

Specific examples of such blocked polyisocyanates include DURANATE TPA-B80X, TPA-B80E, 17B-60PX, and E402-B80T, which are from Asahi Kasei Chemicals Corp.; and DESMODUR BL-3175 and BL4265, which are from Sumika Bayer Urethane Co., Ltd. These materials can be used alone or in combination.

In addition, melamine-type crosslinking agents can also be used as the crosslinking agent. Suitable melamine-type crosslinking agents include butylated melamine, methylated melamine, epoxy-modified melamine, partially or perfectly alkyl-etherified melamine resins, and modified versions of these materials.

Specific examples of such melamine-type crosslinking agents include SUPER BECKAMIN G-821-60, L-110-60, L-127-60, and L-105-60, which are from Dainippon Ink & Chemicals, Inc.; and CYMEL 370 and 771, and MYCOAT 102, which are from Mitsui Chemicals, Inc.

The insulating layer is typically formed by applying a coating liquid, which is prepared by dissolving such a fluorine-containing resin as mentioned above and such a crosslinking agent as mentioned above in an organic solvent, on the electroconductive substrate using a known coating method.

The thickness of the insulating layer, which depends on the constituent material, is preferably from 1 μm to 100 μm, and more preferably from 1 μm to 50 μm. When the thickness of the insulating layer is less than 1 μm, it is hard to prevent occurrence of the leaking problem in that charge leaking occurs between the first and second electrodes. In contrast, when the thickness is greater than 100 μm, the electric field formed by the internal electrode (first electrode) 91A decreases, thereby making it impossible to produce such an electrostatic force that toner particles can hop from the outermost layer.

Next, the outermost layer 98 will be described.

The outermost layer is formed to cover the electrodes, to prevent occurrence of the leaking problem, and to frictionally charge toner particles.

The constituent material of the outermost layer is not particularly limited as long as the outermost layer carries out the functions mentioned above. However, bisphenol-type polycarbonates are preferably used for the outermost layer because the resins have a good combination of frictional charging ability, toner hopping property and abrasion resistance, and thereby a toner cloud is stably formed over a long period of time.

The molecular weight of such a polycarbonate resin constituting the outermost layer is preferably from 30,000 to 60,000 so that the resin can be easily dissolved in a solvent and the resultant resin solution and the outermost layer coating liquid can be easy to handle. When the molecular weight is too small, a problem such that the polycarbonate resin in the outermost layer quickly crystallizes or causes molecular chain relocation, thereby reducing the volume of the outermost layer, resulting in deterioration of the mechanical strength of the layer tends to be caused.

The outermost layer including a polycarbonate resin can include a leveling agent as an additive.

Known materials for use as leveling agents can be used for the outermost layer 98.

Among these leveling agents, silicone oil-type leveling agents can be preferably used because of imparting a smooth surface to the outermost layer even in a small added amount. Specific examples of such silicone oil-type leveling agents include dimethyl silicone oils, methylphenyl silicone oils, methylhydrodiene polysiloxane, cyclic dimethylpolysiloxane, alkyl-modified silicone oils, polyether-modified silicone oils, alcohol-modified silicone oils, fluorine-modified silicone oils, amino-modified silicone oils, mercapto-modified silicone oils, epoxy-modified silicone oils, carboxyl-modified silicone oils, higher fatty acid-modified silicone oils, silicone oils including a higher fatty acid, etc.

The outermost layer can further include proper amounts of additives such as plasticizers and antioxidants.

The outermost layer is typically formed by applying a coating liquid, which is prepared by dissolving such a polycarbonate resin as mentioned above in an organic solvent, on the surface of the toner bearer using a known coating method such as dip coating and spray coating.

The thickness of the outermost layer is not particularly limited as long as a field curtain is formed on the surface of the toner bearer, and the electrode 91B is prevented from being exposed, and is preferably from 0.5 μm to 50 μm. When the thickness of the outermost layer is less than 0.5 μm, it is hard to prevent occurrence of the leaking problem. In contrast, when the thickness is greater than 50 μm, the electric field formed by the electrodes decreases, thereby making it impossible to produce such an electrostatic force that toner particles can hop from the outermost layer. In addition, when the thickness of the outermost layer is from 0.5 μm to 50 μm, toner hopping can be more stably performed.

As mentioned above, by using the toner bearer illustrated in FIG. 3, which includes upper and lower electrodes, dramatic effects can be produced. It is possible to use a toner bearer illustrated in FIG. 4, which has a comb-form electrode, although the magnitude of the effects produced thereby are slightly less than that of the effects produced by the upper and lower electrode-type toner bearer mentioned above.

Next, another toner bearer using a comb-form electrode will be described.

Figure 4B:
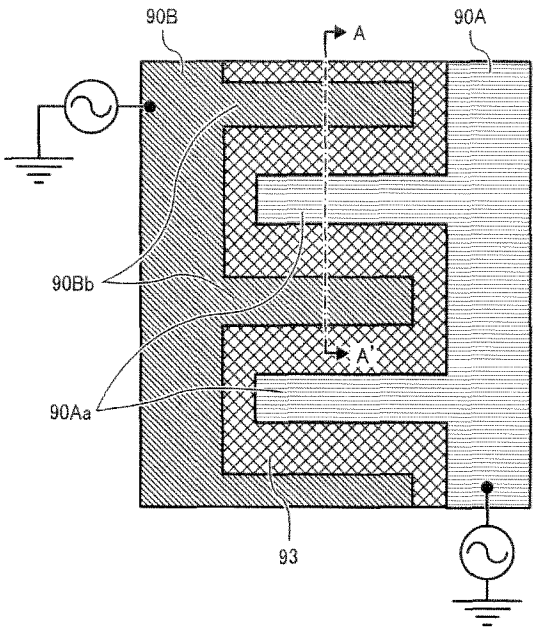
FIGS. 4A and 4B illustrate another example of the toner bearer of this disclosure.
Figure 4A:
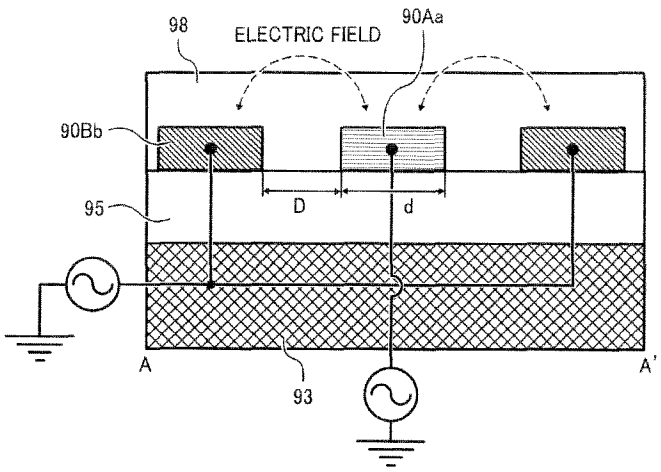

FIG. 4B is a plan view of a comb-form electrode of a toner bearer, and FIG. 4A is a cross-sectional view of the comb-form electrode along a line A-A'.

Referring to FIGS. 4A and 4B, the toner bearer 9 includes a first patterned electrode 90A having plural linear electrodes 90Aa each having a width (d), and a second patterned electrode 90B having plural linear electrodes 90Bb each having a width (d), which are arranged so as to be parallel to the plural linear electrodes 90Aa with an interval (D) therebetween. In this regard, the linear electrodes 90Aa and 90Bb extend in a direction parallel to the axis of the toner bearer 9. As illustrated in FIG. 4A, the toner bearer has a structure such that the insulating layer 95 is located on a cylindrical substrate 93, the electrodes 90Aa and 90Bb are located on the insulating layer 95, and the outermost layer 98 is located on the electrodes 90Aa and 90Bb and a portion of the insulating layer 95.

Specific examples of the cylindrical substrate 93 include insulating cylinders of a synthetic resin such as polyimide resins, polycarbonate resins, nylon resins, fluorine-containing resins, polyacetal resins, phenolic resins, and polystyrene resins; and metal cylinders, which are prepared by subjecting a cylinder of metal such as aluminum, aluminum alloys, nickel, titanium, and stainless steel to a treatment such as cutting and polishing, followed by forming a cover layer of a resin (such as the synthetic resins mentioned above) on the peripheral surface of the metal cylinder.

Next, the toner used for the developing device will be described.

Any known toners such as toners prepared by pulverization methods and toners prepared by polymerization methods can be used for the toner bearer, the developing device and the image forming apparatus of this disclosure.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A toner bearer was prepared as follows.

1. Preparation of Coating Liquid for Forming Insulating Layer

The following components were mixed to prepare an insulating layer coating liquid.

| | |
|---|---|
| Fluorine-containing resin (copolymer of fluoroethylene with a vinyl ether monomer, LUMIFLON LF-200 from Asahi Glass Co., Ltd., which has formula (1) described above) | 190 parts |
| Isocyanate crosslinking agent (TPA-B80E from Asahi Kasei Chemicals Corp.) | 35 parts |
| Methyl ethyl ketone | 75 parts |

2. Preparation of Coating Liquid for Forming Outermost Layer

The following components were mixed to dissolve the polycarbonate resin and silicone oil in the mixture solvent, thereby preparing an outermost layer coating liquid.

| | |
|---|---|
| Tetrahydrofuran | 70 parts |
| Cyclohexanone | 30 parts |
| Bisphenol Z-form polycarbonate resin (PANLITE TS-2050 from Teijin Chemicals Ltd., having molecular weight of 50,000 and the following formula | 3 parts |

-continued

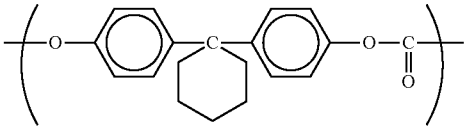

| | |
|---|---|
| Silicone oil (KF-50 from Shin-Etsu Chemical Co., Ltd.) | 0.002 parts |

3. Preparation of Toner Bearer

A cylindrical aluminum tube having a diameter of 16 mm and a length of 230 mm, which serves as an electroconductive substrate, was dipped into the above-prepared insulating layer coating liquid, followed by heating for 60 minutes at 180° C. to crosslink the layer. Thus, an insulating layer with a thickness of 20 μm was formed on the peripheral surface of the cylindrical electroconductive substrate, i.e., an electroconductive substrate 91A having an insulating layer 95 thereon was prepared.

A copper film with a thickness of 0.8 μm was formed on the insulating layer by a vapor deposition method. In addition, a resist film with a thickness of 5 μm was formed on the copper film. The resist film was irradiated with laser light emitted by a laser image forming device to draw a latent image of the patterned electrode (91B) in which plural linear electrodes 91Bb each having a width (d) of 100 μm and a length (L) of 200 mm are arranged at regular intervals (D) of 200 μm, followed by a development process in which the latent image is developed with an aqueous solution of sodium carbonate ($Na_2CO_3$), and an etching process in which the developed image is dipped into an aqueous solution of ferric chloride ($FeCl_3$). Thus, the patterned electrode 91B having the electrodes 91Bb was prepared on the insulating layer 95.

Next, the above-prepared outermost layer coating liquid was coated on the patterned electrode 91B by a spray coating method while one side end portion of the electrode is masked, followed by heating for 60 minutes at 160° C. to prepare the outermost layer 98 with a thickness of 10 μm.

The thus prepared toner bearer 9, in which one side end thereof is exposed without covered with the outermost layer, was incorporated into the developing device 4. An alternate voltage having peaks at −400V and 0V and an average potential of −200V while having a frequency of 5 KHz was applied by a power source to a terminal provided at the opening 8*a* of the developing device 4. In this regard, a black toner for use in an image forming apparatus IMAGIO NEO C320 from Ricoh Co., Ltd. was used.

This developing device was set in the black image forming station of an image forming apparatus IMAGIO NEO C320 to produce black images. In this image forming operation, the following evaluations were performed.

1. The power consumption of the developing device was checked.
2. Whether or not the leaking problem occurs between the electroconductive substrate 91A and the electrodes 91Bb was checked. Specifically, whether or not the potential difference therebetween is maintained when a voltage is applied is checked by a multimeter or an oscilloscope.
3. Toner particles hopping on the toner bearer were visually observed to check the hopping state of the toner.
4. The produced images were visually observed to determine whether or not abnormal images are formed.

Example 2

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of fluoroethylene with a vinyl ether monomer, LUMIFLON LF-906N from Asahi Glass Co., Ltd., which has formula (1) described above) | 140 parts |
| Isocyanate crosslinking agent (TPA-B80E from Asahi Kasei Chemicals Corp.) | 66 parts |
| Methyl ethyl ketone | 93 parts |

Example 3

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of fluoroethylene with a vinyl ether monomer, LUMIFLON LF-400 from Asahi Glass Co., Ltd., which has formula (1) described above) | 240 parts |
| Isocyanate crosslinking agent (TPA-B80E from Asahi Kasei Chemicals Corp.) | 32 parts |
| Methyl ethyl ketone | 30 parts |

Example 4

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of fluoroethylene with a vinyl ether monomer, LUMIFLON LF-200F from Asahi Glass Co., Ltd., which has formula (1) described above) | 100 parts |
| Isocyanate crosslinking agent (TPA-B80E from Asahi Kasei Chemicals Corp.) | 33 parts |
| Methyl ethyl ketone | 165 parts |

Example 5

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of fluoroethylene with a vinyl ether monomer, LUMIFLON LF-200 from Asahi Glass Co., Ltd., which has formula (1) described above) | 190 parts |
| Isocyanate crosslinking agent (TPA-100 from Asahi Kasei Chemicals Corp.) | 19 parts |
| Methyl ethyl ketone | 90 parts |

Example 6

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of fluoroethylene with a vinyl ether monomer, LUMIFLON LF-200 from Asahi Glass Co., Ltd., which has formula (1) described above) | 190 parts |
| Isocyanate crosslinking agent (D-177 from Mitsui Chemicals Inc.) | 22 parts |
| Methyl ethyl ketone | 90 parts |

Example 7

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of tetrafluoroethylene with a vinyl monomer, ZEFFLE GK-570 from Daikin Industries, Ltd.) | 166 parts |
| Isocyanate crosslinking agent (TPA-B80E from Asahi Kasei Chemicals Corp.) | 41 parts |
| Methyl ethyl ketone | 92 parts |

Example 8

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of tetrafluoroethylene with a vinyl monomer, ZEFFLE GK-580 from Daikin Industries, Ltd.) | 240 parts |
| Isocyanate crosslinking agent (D-177 from Mitsui Chemicals Inc.) | 20 parts |
| Methyl ethyl ketone | 30 parts |

Example 9

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of tetrafluoroethylene with a vinyl monomer, ZEFFLE GK-500 from Daikin Industries, Ltd.) | 180 parts |
| Isocyanate crosslinking agent (TPA-B80E from Asahi Kasei Chemicals Corp.) | 41 parts |
| Methyl ethyl ketone | 75 parts |

Example 10

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of tetrafluoroethylene with a vinyl monomer, ZEFFLE GK-510 from Daikin Industries, Ltd.) | 240 parts |
| Isocyanate crosslinking agent (TPA-100 from Asahi Kasei Chemicals Corp.) | 25 parts |
| Methyl ethyl ketone | 30 parts |

Example 11

The procedure for preparation and evaluation of the toner bearer of Example 1 was repeated except that the insulating layer coating liquid was replaced with the following insulating layer coating liquid.

| | |
|---|---|
| Fluorine-containing resin (copolymer of tetrafluoroethylene with a vinyl monomer, ZEFFLE GK-550 from Daikin Industries, Ltd.) | 160 parts |
| Isocyanate crosslinking agent (TPA-B80E from Asahi Kasei Chemicals Corp.) | 59 parts |
| Methyl ethyl ketone | 75 parts |

Comparative Example 1

The procedure for preparation and evaluation of the toner bearer of Example 1 was repeated except that the insulating layer coating liquid was replaced with the following insulating layer coating liquid.

| | |
|---|---|
| Alkyd resin (BECKOLITE M6401-50 from) | 110 parts |
| Crosslinking agent (melamine resin, SUPER BECKAMIN G-821-60 from Dainippon Ink & Chemicals, Inc.) | 60 parts |
| Methyl ethyl ketone | 110 parts |

Comparative Example 2

The procedure for preparation and evaluation of the toner bearer of Example 1 was repeated except that the insulating layer coating liquid was replaced with the outermost layer coating liquid used for Example 1.

Comparative Example 3

The procedure for preparation and evaluation of the toner bearer of Example 1 was repeated except that the insulating layer coating liquid was replaced with the following insulating layer coating liquid.

| | |
|---|---|
| Polyvinyl butyral resin (S-LEC BX-1 from Sekisui Chemical Co., Ltd.) | 30 parts |
| Methyl ethyl ketone | 70 parts |

The evaluation results are shown in Table 1 below.

TABLE 1

| | Electric power consumption (W) | Leaking problem | Hopping state of toner | Abnormal image |
|---|---|---|---|---|
| Example 1 | 20.7 | No | Good | No |
| Example 2 | 20.9 | No | Good | No |
| Example 3 | 21.2 | No | Good | No |
| Example 4 | 21.7 | No | Good | No |
| Example 5 | 21.6 | No | Good | No |
| Example 6 | 21.3 | No | Good | No |
| Example 7 | 20.6 | No | Good | No |
| Example 8 | 21.1 | No | Good | No |
| Example 9 | 21.2 | No | Good | No |
| Example 10 | 21.4 | No | Good | No |
| Example 11 | 20.9 | No | Good | No |
| Comparative Example 1 | 28.7 | No | Good | No |
| Comparative Example 2 | Not measurable due to leaking problem | Yes | Toner did not hop. | Yes (no image) |
| Comparative Example 3 | Not measurable due to leaking problem | Yes | Toner did not hop. | Yes (no image) |

It is clear from Table 1 that the toner bearers of Examples 1-11 have a relatively low power consumption compared to the toner bearer of Comparative Example 1. In addition, the toner bearers of Examples 1-11 produced good images without causing the leaking problem and the hopping problem.

In contrast, the toner bearers of Comparative Examples 2 and 3 caused the leaking problem. Since leakage occurred between the electroconductive substrate and the electrodes, a potential difference was not formed therebetween, and therefore toner particles did not hop from the comparative toner bearers, resulting in formation of no image.

Additional modifications and variations of the present invention are possible in light of the above teachings. It is therefore to be understood that within the scope of the appended claims the invention may be practiced other than as specifically described herein.

What is claimed is:

1. A toner bearer comprising:

an electroconductive substrate;

an insulating layer located on the electroconductive substrate and including at least a crosslinked material having a unit obtained from a fluorine-containing resin and a crosslinking agent, wherein the fluorine-containing resin is selected from the group consisting of copolymers having a unit obtained from fluoroethylene having at least three fluorine atoms and a unit obtained from a vinyl ether monomer and copolymers including a unit obtained from tetrafluoroethylene and a unit obtained from a vinyl monomer;

multiple electrodes located on the insulating layer at regular intervals;

an outermost layer located on the multiple electrodes and a portion of the insulating layer on which the multiple electrodes are not present; and a voltage applicator to apply a voltage between the electroconductive substrate and the multiple electrodes to form a periodically reversed electric field therebetween, so that toner particles on the outermost layer hop, thereby forming a toner cloud above the outermost layer.

2. The toner bearer according to claim 1, wherein the fluorine-containing resin is a polyol.

3. The toner bearer according to claim 1, wherein the crosslinking agent is an isocyanate crosslinking agent.

4. The toner bearer according to claim 3, wherein the isocyanate crosslinking agent is a blocked isocyanate crosslinking agent.

5. The toner bearer according to claim 1, wherein the outermost layer includes a polycarbonate resin.

6. A developing device comprising:

a developer container containing a toner therein;

an agitator to agitate the toner in the developer container;

the toner bearer according to claim 1; and a toner layer forming member to form a toner layer on the toner bearer, wherein toner particles in the toner layer formed on the toner bearer hop and thereby a toner cloud is formed above the outermost layer of the toner bearer to develop an electrostatic latent image on an image bearing member with the toner cloud.

7. An image forming apparatus comprising:

an image bearing member to bear an electrostatic latent image thereon; and the developing device according to claim 6 to develop the electrostatic latent image with the toner cloud to form a toner image on the image bearing member.

8. A toner bearer comprising:

a substrate;

an insulating layer located on the substrate and including at least a crosslinked material having a unit obtained from a fluorine-containing resin and a crosslinking agent, wherein the fluorine-containing resin is selected from the group consisting of copolymers having a unit obtained from fluoroethylene having at least three fluorine atoms and a unit obtained from a vinyl ether monomer and copolymers including a unit obtained from tetrafluoroethylene and a unit obtained from a vinyl monomer;

multiple electrodes located on the insulating layer at regular intervals, wherein the multiple electrodes include a first patterned electrode having plural first linear electrodes, and a second patterned electrode having plural second linear electrodes, and wherein the plural first linear electrodes and the plural second linear electrodes are alternately arranged in parallel at regular intervals;

an outermost layer located on the multiple electrodes and a portion of the insulating layer on which the multiple electrodes are not present; and a voltage applicator to apply voltages having different phases to the plural first linear electrodes and plural second linear electrodes, respectively, to form a periodically reversed electric field therebetween, so that toner particles on the outermost layer hop, thereby forming a toner cloud above the outermost layer.

* * * * *